United States Patent [19]

Nathasingh et al.

[11] Patent Number: 4,473,413

[45] Date of Patent: Sep. 25, 1984

[54] AMORPHOUS ALLOYS FOR ELECTROMAGNETIC DEVICES

[75] Inventors: Davidson M. Nathasingh, Stanhope; Amitava Datta, Morris Township, Morris County; Ronald J. J. Martis, Madison; Nicholas J. DeCristofaro, Chatham, all of N.J.

[73] Assignee: Allied Corporation, Morris Township, N.J.

[21] Appl. No.: 475,782

[22] Filed: Mar. 16, 1983

[51] Int. Cl.[3] ..... C22C 38/02

[52] U.S. Cl. ..... 148/31.5; 148/31.55; 75/126 A; 75/126 P; 75/126 Q

[58] Field of Search ..... 148/31.55, 31.5, 403; 75/126 A, 126 P, 126 Q

[56] References Cited

U.S. PATENT DOCUMENTS

| | | | |
|---|---|---|---|
| 3,856,513 | 12/1974 | Chen et al. | 75/123 D |
| 3,940,293 | 2/1976 | Polk et al. | 148/403 |
| 4,116,682 | 9/1978 | Polk et al. | 75/123 D |
| 4,144,058 | 3/1979 | Chen et al. | 148/403 |
| 4,264,358 | 4/1981 | Johnson et al. | 148/403 |

*Primary Examiner*—John P. Sheehan

*Attorney, Agent, or Firm*—Ernest D. Buff; Paul Yee; Gerhard H. Fuchs

[57] ABSTRACT

An iron based, boron, silicon, carbon and chromium containing magnetic alloy having at least 85 percent of its structure in the form of an amorphous metal matrix is annealed at a temperature and for a time sufficient to induce precipitation therein of discrete particles of its constituents and to form an oxide layer on the surface of the matrix. The resulting alloy has decreased high frequency core losses and increased low field permeability; it is particularly suited for high frequency applications.

9 Claims, 4 Drawing Figures

D = PARTICLE DIAMETER
d = INTERPARTICLE SPACING

AMORPHOUS ALLOYS FOR ELECTROMAGNETIC DEVICES

DESCRIPTION

Background of the Invention

1. Field of the Invention

The invention relates to iron-boron base amorphous metal alloy compositions and, in particular, to amorphous alloys containing iron, boron, silicon, chromium and carbon having enhanced high frequency magnetic properties.

2. Description of the Prior Art

Investigations have demonstrated that it is possible to obtain solid amorphous materials from certain metal alloy compositions. An amorphous material substantially lacks any long range atomic order and is characterized by an X-ray diffraction profile consisting of broad intensity maxima. Such a profile is qualitatively similar to the diffraction profile of a liquid or ordinary window glass. This is in contrast to a crystalline material which produces a diffraction profile consisting of sharp, narrow intensity maxima.

These amorphous materials exist in a metastable state. Upon heating to a sufficiently high temperature, they crystallize with evolution of the heat of crystallization, and the X-ray diffraction profile changes from one having amorphous characteristics to one having crystalline characteristics.

Novel amorphous metal alloys have been disclosed by H. S. Chen and D. E. Polk in U.S. Pat. No. 3,856,513, issued Dec. 24, 1974. These amorphous alloys have the formula $M_aY_bZ_c$ where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications in the form of ribbon, sheet, wire, powder, etc. The Chen and Polk patent also discloses amorphous alloys having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

At the time that the amorphous alloys described above were discovered, they evidenced magnetic properties that were superior to then known polycrystalline alloys. Nevertheless, new applications requiring improved magnetic properties and higher thermal stability have necessitated efforts to develop additional alloy compositions.

SUMMARY OF THE INVENTION

In accordance with the present invention, there is provided an iron based boron and chromium containing magnetic alloy having at least 85 percent of its structure in the form of an amorphous metal matrix, the alloy is annealed at a temperature and for a time sufficient to induce precipitation of discrete particles of its constituents in the amorphous metal matrix and to form a chromium oxide layer on the surface of the matrix. Precipitated discrete particles of the alloy have an average size ranging from about 0.05 μm to 1 μm and an average interparticle spacing of about 1 μm to about 10 μm, and constitute an average volume fraction of the discrete particles of about 0.01 to 0.3. Annealing of the alloy is conducted in the presence of a magnetic field. However, it has been found that excellent magnetic properties are obtained at reduced manufacturing costs by annealing the alloy in the absence of a magnetic field. Preferably, the alloy is composed of a composition having the formula $Fe_aB_bSi_cC_d$ and $Cr_e$ wherein "a", "b", "c", "d" and "e" are atomic percentages ranging from about 75 to 83, 15 to 17, 4.5 to 5.5, 0.1 to 0.75 and 1 to 3, respectively, with the proviso that the sum of "a", "b", "c", "d" and "e" equals 100.

Further, the invention provides a method of enhancing magnetic properties of the alloy set forth above, method which comprises the steps of (a) quenching a melt of the alloy at a rate of about $10^{5°}$ to $10^{6°}$ C./sec to form said alloy into continuous ribbon; (b) coating said ribbon with an insulating layer such as magnesium oxide; (c) annealing said coated ribbon at a temperature and for a time sufficient to induce precipitation of discrete particles in the amorphous metal matrix thereof.

Alloys produced in accordance with the method of this invention are not more than 30 percent crystalline and preferably not more than about 15 percent crystalline as determined by X-ray diffraction, electron diffraction, or transmission electron microscopy.

Alloys produced by the method of this invention exhibit improved high frequency magnetic properties that remain stable at temperatures up to about 150° C. As a result, the alloys are particularly suited for use in energy storage inductors, pulse transformers, transformers for switch mode power supplies, current transformers and the like.

BRIEF DESCRIPTION OF THE DRAWINGS

The invention will be more fully understood and further advantages will become apparent when reference is made to the accompanying drawings, in which.

DETAILED DESCRIPTION OF THE INVENTION

Figure 1:
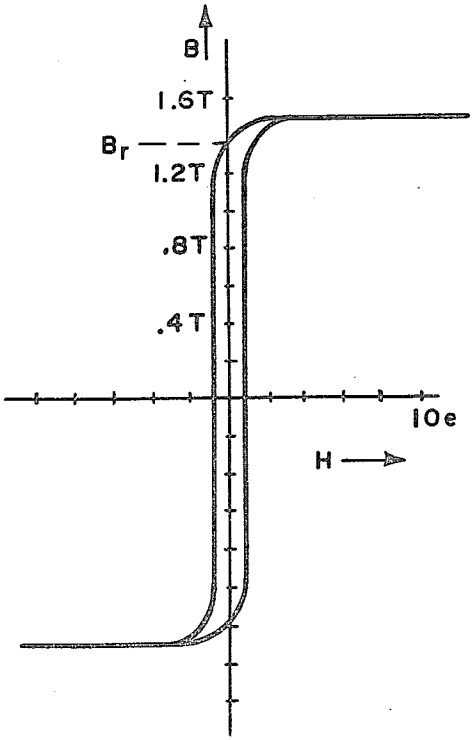
FIG. 1 is a graph showing the relationship between induction and magnetizing force for amorphous alloys in which precipitated discrete crystalline particles are absent.

The composition of the new iron based amorphous alloys, preferably consists essentially of 75 to 83 atom percent iron, 15 to 17 atom percent boron, 4.5 to 5.5 atom percent silicon and 0.1 to 0.75 atom percent carbon and 1 to 3 atom percent chromium. Such compositions exhibit enhanced high frequency magnetic properties when annealed in accordance with the method of the invention. The improved magnetic properties are evidenced by high magnetization, low core loss and low volt-ampere demand. An especially preferred composition within the foregoing ranges consists of 76.85 atom percent iron, 16.1 atom percent boron, 4.8 atom percent silicon, 0.25 atom percent carbon and 2 atom percent chromium.

Alloys treated by the method of the present invention are not more than 30 percent crystalline and preferably are about 15 percent crystalline. High frequency magnetic properties are improved in alloys possessing the preferred volume percent of crystalline material. The volume percent of crystalline material is conveniently determined by X-ray diffraction, electron diffraction or transmission electron microscopy.

The core loss and exciting power measured at 50 kHz and 0.1 T for alloys outside the scope of the invention are set forth below in Table I.

TABLE I

| Alloy | | | | | Core Loss (W/kg) | Exciting Power (VA/kg) |
|---|---|---|---|---|---|---|
| $Fe_{79}$ | $B_{14}$ | $Si_{4.75}$ | $Cr_2$ | $C_{0.25}$ | 12 | 31 |
| $Fe_{73}$ | $B_{20}$ | $Si_{4.75}$ | $Cr_2$ | $C_{0.25}$ | 34 | 53 |
| $Fe_{85}$ | $B_8$ | $Si_{4.75}$ | $Cr_2$ | $C_{0.25}$ | 44 | 77 |
| $Fe_{81}$ | $B_{12}$ | $Si_{4.75}$ | $Cr_2$ | $C_{0.25}$ | 10 | 27 |
| $Fe_{83}$ | $B_{10}$ | $Si_{4.75}$ | $Cr_2$ | $C_{0.25}$ | 10 | 37 |
| $Fe_{77}$ | $B_{17.5}$ | $Si_{4.75}$ | $Cr_{0.5}$ | $C_{0.25}$ | 18 | 29 |
| $Fe_{77.75}$ | $B_{16}$ | $Si_4$ | $Cr_2$ | $C_{0.25}$ | 16 | 27 |
| $Fe_{75.75}$ | $B_{16}$ | $Si_6$ | $Cr_2$ | $C_{0.25}$ | 16 | 42 |
| $Fe_{77}$ | $B_{16}$ | $Si_5$ | $Cr_2$ | | 8 | 29 |
| $Fe_{76}$ | $B_{16}$ | $Si_5$ | $Cr_2$ | $C_1$ | 14 | 16 |
| $Fe_{77}$ | $B_{14}$ | $Si_{4.75}$ | $Cr_4$ | $C_{0.25}$ | 19 | 01 |
| $Fe_{75}$ | $B_{18}$ | $Si_{4.75}$ | $Cr_2$ | $C_{0.25}$ | 14 | 23 |

The core loss and exciting power measured at 50 kHz and 0.1 T for alloys inside the scope of the invention are set forth below in Table II.

TABLE II

| Alloy | | | | | Core Loss (W/kg) | Exciting Power (VA/kg) |
|---|---|---|---|---|---|---|
| $Fe_{77}$ | $B_{16}$ | $Si_{4.75}$ | $Cr_2$ | $C_{0.25}$ | 5 | 14 |
| $Fe_{77}$ | $B_{17}$ | $Si_{4.75}$ | $Cr_1$ | $C_{0.25}$ | 10 | 23 |
| $Fe_{76.5}$ | $B_{15.5}$ | $Si_{4.5}$ | $Cr_3$ | $C_{0.50}$ | 7 | 19 |
| $Fe_{77}$ | $B_{15}$ | $Si_{5.5}$ | $Cr_2$ | $C_{0.50}$ | 9 | 26 |
| $Fe_{76}$ | $B_{16}$ | $Si_{5.25}$ | $Cr_2$ | $C_{0.75}$ | 9 | 20 |
| $Fe_{76}$ | $B_{16.9}$ | $Si_5$ | $Cr_2$ | $C_1$ | 10 | 21 |

The amorphous metal alloys are formed by cooling a melt at a rate of about $10^{5°}$ to $10^{6°}$ C./sec. The purity of all materials is that found in normal commercial practice. A variety of techniques are available for fabricating splat-quenched foils and rapid-quenched continuous ribbons, wire, sheet, etc. Typically, a particular composition is selected, powders or granules of the requisite elements (or of materials that decompose to form the elements, such as ferroboron, ferrosilicon, etc.) in the desired proportions are melted and homogenized, and the molten alloy is rapidly quenched on a chill surface, such as a rotating cylinder.

The magnetic properties of the subject alloys can be enhanced by annealing the alloys. The method of annealing generally comprises heating the alloy to a temperature for a time to induce precipitation of discrete crystalline particles within the amorphous metal matrix, such particles having an average size ranging from about 0.05 to 1 μm, an average interparticle spacing of about 1 to 10 μm and constituting an average volume fraction of about 0.01 to 0.3. The annealing step is typically conducted in the presence of a magnetic field, the strength of which ranges from about 1 Oersted (80 amperes per meter) to 10 Oersteds (800 amperes per meter). However, as noted hereinabove, excellent magnetic properties are obtained and manufacturing costs are reduced by annealing the alloy in the absence of a magnetic field.

It has been discovered that in the absence of discrete crystalline particles, amorphous alloys of this invention exhibit square d.c. B-H loops with high remanent magnetization ($B_r$); as in FIG. 1. Henceforth, square d.c. B-H loops will be referred to as Type A. Square loop material will yield large power losses at high frequencies.

Figure 2:
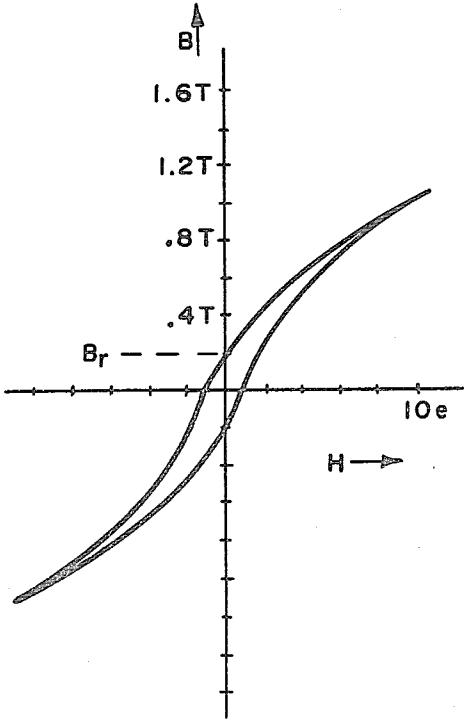
FIG. 2 is a graph showing the relationship between induction and magnetizing force for amorphous alloys of the present invention containing an optimum volume fraction of discrete particles.

At the optimum level of discrete crystalline particle density, the d.c. B-H loop is sheared with substantially reduced $B_r$, as in FIG. 2. Henceforth, sheared d.c. B-H loops will be referred to as Type B. Sheared loop material exhibits increased low field permeabilities and reduced core losses at high frequencies. Typically, the high frequency core loss of sheared loop material is approximately one-half the loss of square loop material. Lower core loss results in less heat build-up in the core and permits the use of less core material at a higher induction level for a given operating temperature.

Figure 3:
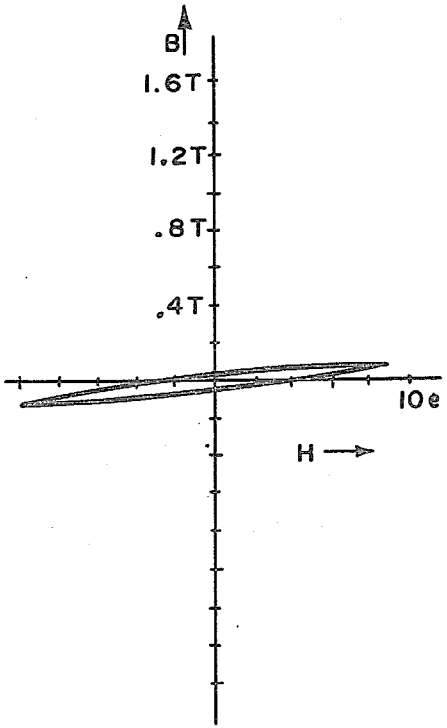
FIG. 3 is a graph showing the relationship between induction and magentizing force for amorphous alloys of the invention containing a volume fraction of discrete particles larger than the optimum amount.

If the alloy is annealed to precipitate a volume fraction of discrete crystalline particles larger than the optimum amount, the d.c. B-H loop becomes flat with near zero $B_r$, as shown in FIG. 3. Henceforth, flat d.c. B-H loops will be referred to as Type C. The exciting power necessary to drive flat loop material is extremely large, reaching values up to ten times the exciting power of sheared or square loop material.

At high frequencies the dominant component of the total core loss is the eddy current loss, which decreases with the ferromagnetic domain size. By reducing the domain size, the high frequency core loss can be minimized. It has been found that the domain size can be reduced by controlled precipitation of discrete α-(Fe, Si) particles, which act as pinning points for the domain walls.

Similarly, the extent to which core loss is minimized depends upon the alloy's volume fraction of discrete α-(Fe, Si) particles. When the volume fraction increases beyond 30%, the soft magnetic characteristics of the amorphous matrix begin to deteriorate and the crystalline α-(Fe, Si) particles offer excessive resistance to the domain wall motion. It has been found necessary to control the volume fraction of the discrete crystalline particles within a range of about 1-30%. The volume fraction is a function of the interparticle spacing and particle size. It has been found that the particle size preferably ranges from about 0.1 to 0.5 μm.

One of the major problems encountered during production of iron, boron and silicon containing magnetic alloy strip is the difficulty of preventing the formation of silicon oxide layers on the strip during the quenching or annealing steps. The silicon oxide layer increases the magnetic losses of cores formed from the strip and cause magnetic properties of the strip to vary from one batch to another. It has been discovered that the addition of chromium to the iron- boron- silicon containing alloys of this invention prevents formation of the silicon oxide layer during the quenching and annealing steps. Surprisingly, strip formed in accordance with the present invention is coated with a chromium oxide layer having an average thickness ranging from about 6 to 10 nm and preferably at least about 8 nm. Without the addition of carbon, this chromium oxide layer maintains a constant thickness throughout the quenching and annealing steps, whether the annealing process is conducted in the presence or in the absence of a magnetic field.

In order to control the volume fraction of α-crystals produced in the strip during the annealing step, carbon is added to the iron-boron-silicon-chromium containing alloys in an amount ranging from about 0.1 to 0.75, and preferably about 0.25 to 0.5 atom percent. The addition of carbon does not affect the composition of the surface oxide layers formed during the quenching or annealing steps. These layers retain their chromium oxide composition and their thickness during the quenching step as before. However, the presence of carbon in the Fe-B-Si-Cr alloys of the invention causes the thickness of the chromium oxide layers to increase substantially during the annealing step. Typically, with such carbon addition to the alloys of the invention, the chromium oxide layer increases from 8 nm to as much as 15 nm or more.

Figure 4:
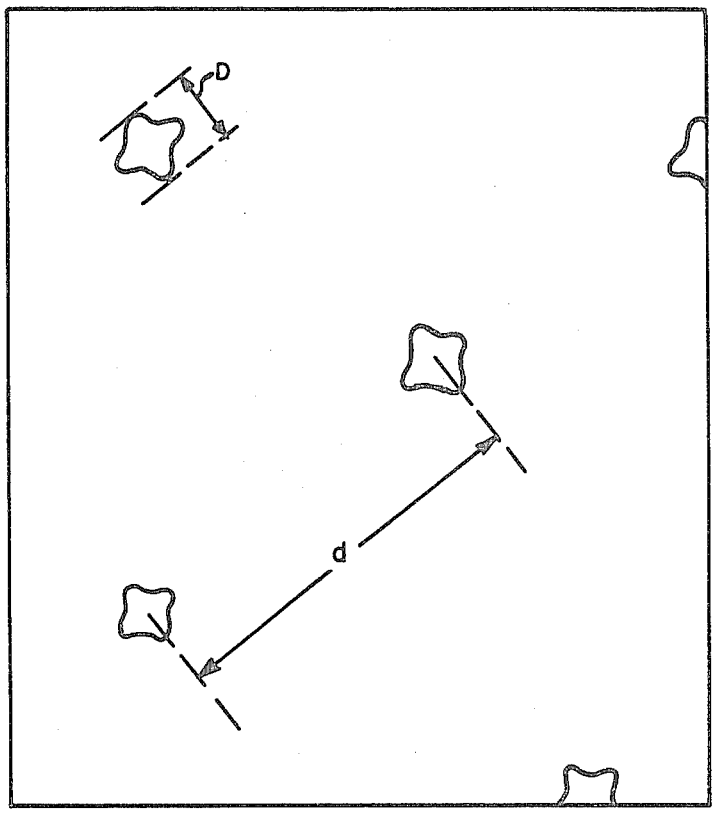
FIG. 4 is a schematic representation of an alloy of the invention, showing the distribution of discrete particles therein.

For amorphous alloys containing about 75 to 83 atom percent iron, 15 to 17 atom percent boron, 4.5 to 5.5 atom percent silicon, 0.1 to 0.75 atom percent carbon and 1 to 3 atomic percent chromium, torodial samples must be heated to temperatures between about 425° C. and 445° C. for times from about 3 to 5 hours to induce the optimum distribution of discrete crystalline particles. The specific time and temperature is dependent on alloy composition and quench rate. For iron boron base alloys such as $Fe_{76}B_{16}Si_{5.25}Cr_2C_{0.75}$ and $Fe_{76}B_{16.1}Si_{4.8}Cr_2C_{0.25}$ the discrete crystalline particles are star shaped, α-(Fe, Si) precipitates, as illustrated in FIG. 4. The precipitate size ranges from about 0.1 to 0.3 μm. The preferred average interparticle spacing (d) ranges from about 1.0 to 10. μm, corresponding to a optimum volume fraction of about 0.01 to 0.15. To calculate interparticle spacing from election micrographs, care must be taken to account for the projection of three dimensional arrays onto a two dimensional image.

Applications wherein low core losses are particularly advantageous include energy storage inductors, pusle transformers, transformers that switch mode power supplies, current transformers and the like.

As discussed above, alloys annealed by the method of the present invention exhibit improved magnetic properties that are stable at temperatures up to about 150° C. The temperature stability of the present alloys allows utilization thereof in high temperature applications.

When cores comprising the subject alloys are utilized in electromagnetic devices, such as transformers, they evidence low power loss and low exciting power demand, thus resulting in more efficient operation of the electromagnetic device. The loss of energy in a magnetic core as the result of eddy currents, which circulate through the core, results in the dissipation of energy in the form of heat. Cores made from the subject alloys require less electrical energy for operation and produce less heat. In applications where cooling apparatus is required to cool the transformer cores, such as transformers in aircraft and large power transformers, an additional savings is realized since less cooling apparatus is required to remove the smaller amount of heat generated by cores made from the subject alloys. In addition, the high magnetization and high efficiency of cores made from the subject alloys result in cores of reduced weight for a given capacity rating.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE I

Toroidal test samples were prepared by winding approximately 0.030 kg of 0.0254 m wide alloy ribbon of the composition $Fe_{76.85}B_{16.1}Si_{4.8}Cr_2C_{0.25}$ on a steatite core having inside and outside diameters of 0.0397 m and 0.0445 m, respectively. The alloy was cast into ribbon by quenching the alloy on a copper beryllium substrate. One hundred and fifty turns of high temperature magnetic wire were wound on the toroid to provide a d.c. circumferential field of up to 795.8 ampere/meter for annealing purposes. The high temperature magnetic wire was not placed on those samples to be annealed without field. The samples were annealed in an inert gas atmosphere at temperatures from 420° C. to 450° C. for times from 2 hours to 4 hours 30 minutes with the 795.8 A/m field applied during heating and cooling to those samples designated field annealed samples.

Annealed values are set forth in Tables III and IV. Each of the alloys of Tables III and IV is within the scope of the present invention. The annealing procedures of Table III are outside the scope of the invention, whereas the annealing procedures of Table IV are within the scope of the present invention.

The presence of α-crystals and the volume fraction of the α-crystal particles in the annealed samples (both field and no-field) were measured by transmission electron microscopy. These parameters plus the 50 kHz, 0.1 T power loss and exciting power are set forth in Table V as a function of annealing conditions.

Samples of as-cast and annealed compositions were analyzed for surface oxidation by secondary ion mass spectrometry (SIMS) and Scanning Auger Microscopy (SAM). The dull and shiny sides of all samples were analyzed. Sample 1 exhibited an 8 nm silicon oxide layer in both the quenched and annealed condition. This is typical to previously analyzed ribbon in the Fe-B-Si system. The silicon oxide layer was present in equal concentrations on both dull and shiny sides of the ribbon. Sample 2, like Sample 1, exhibited the same thickness magnitude for both dull and shiny sides of the ribbon. However, the composition of the oxide layer in Sample 2 was determined to be Chromium Oxide. The Oxide layer thickness did not change after annealing, nor did the composition.

Samples 3–5 also contained substantially the same oxide layer thickness as samples 1–2 in the quenched condition. After annealing, however, the Oxide layer increased from about 8 or 9 to about 15 nm. The composition of the oxide layer in Samples 3–5 was determined to be Chromium Oxide. The ribbon analyses, thicknesses and compositions of their oxide layers are set forth in Table VI.

TABLE III

| ALLOY: $Fe_{76.85}B_{16.1}Si_{4.8}Cr_2C_{0.25}$ | | |
|---|---|---|
| | 50 kHz, 0.1T | |
| Anneal Procedure | Core Loss (w/kg) | Exciting Power (VA/kg) |
| 2 HR @ 420° C., 795.8 A/m circumferential field | 18 | 23 |

TABLE III-continued

| ALLOY: $Fe_{76.85}B_{16.1}Si_{4.8}Cr_2C_{0.25}$ | 50 kHz, 0.1T | |
|---|---|---|
| Anneal Procedure | Core Loss (w/kg) | Exciting Power (VA/kg) |
| 2 HR @ 420° C., No field | 23 | 29 |
| 4 HR, 30 mins. @ 420° C., 795.8 A/m circumferential field | 10 | 49 |
| 4 HR, 30 mins. @ 420° C., No field | 13 | 43 |
| 3 HR, 30 mins. @ 450° C., 795.8 A/m circumferential field | 10 | 61 |
| 3 HR, 30 mins. @ 450° C., No field | 11 | 54 |
| 4 HR, 30 min. @ 450° C., 795.8 A/m circumferential field | 11 | 161 |
| 4 HR, 30 min., No field | 16 | 149 |

TABLE IV

| ALLOY: $Fe_{76.85}B_{16.1}Si_{4.8}Cr_2C_{0.25}$ | 50 kHz, 0.1T | |
|---|---|---|
| Anneal Procedure | Core Loss | Exciting Power |
| 3 HR, 425° C., 795.8 A/m Circumferential field | 9 | 21 |
| 3 HR, 425° C., No field | 10 | 24 |
| 3 HR, 30 mins. @ 435° C., 795.8 A/m Circumferential field | 5 | 14 |
| 3 HR, 30 mins. @ 435° C. | 5 | 14 |
| 4 HR @ 425° C., 795.8 A/m Circumferential field | 8 | 19 |
| 4 HR @ 425° C., No field | 8 | 19 |
| 3 HR @ 445° C., No field | 6 | 27 |
| 4 HR @ 445° C., No field | 8 | 23 |

TABLE V

| ALLOY COMPOSITION | ANNEAL | MORPHOLOGY | 50 kHz, 0.1T Core Loss (W/kg) | 50 kHz, 0.1T Exciting Power (VA/kg) |
|---|---|---|---|---|
| $Fe_{79}B_{16}Si_5$ | 2 HRS, 430° C. 795.8 A/m circumferential field | No discrete particles in the Amorphous Matrix | 25 | 47 |
| $Fe_{79}B_{16}Si_5$ | 3½ HRS, 430° C. 795.8 A/m circumferential field | α-crystals, <15% Volume Fraction | 5 | 18 |
| $Fe_{76.85}B_{16.1}Si_{4.8}Cr_2C_{0.25}$ | 2 HRS, 435° C., 795.8 A/m circumferential field | No discrete particles in the Amorphous Matrix | 16 | 37 |
| $Fe_{76.85}B_{16.1}Si_{4.8}Cr_2C_{0.25}$ | 3½ HRS, 435° C. 795.8 A/m circumferential field | α-crystals, <15% Volume Fraction | 5 | 14 |
| $Fe_{76.85}B_{16.1}Si_{4.8}Cr_2C_{0.25}$ | 3½ HRS, 435° C. | α-crystals, <15% Volume Fraction | 5 | 14 |
| $Fe_{76.85}B_{16.1}Si_{4.8}Cr_2C_{0.25}$ | 3½ HRS, 450° C. 795.8 A/m circumferential field | α-crystals, >15% Volume Fraction | 8 | 65 |
| $Fe_{76.85}B_{16.1}Si_{4.8}Cr_2C_{0.25}$ | 3½ HRS, 450° C. | α-crystals, >15% Volume Fraction | 9 | 78 |
| $Fe_{76.85}B_{16.1}Si_{4.8}Cr_2C_{0.25}$ | 3 HRS, 425° C. 795.8 A/m circumferential field | α-crystals, <15% Volume Fraction | 10 | 21 |
| $Fe_{76.85}B_{16.1}Si_{4.8}Cr_2C_{0.25}$ | 4 HRS, 445° C. 795.8 A/m circumferential field | α-crystals, <15% Volume Fraction | 8 | 26 |
| $Fe_{76.85}B_{16.1}Si_{4.8}Cr_2C_{0.25}$ | 4 HRS, 425° C. 795.8 A/m circumferential field | α-crystals, <15% Volume Fraction | 8 | 19 |
| $Fe_{76.85}B_{16.1}Si_{4.8}Cr_2C_{0.25}$ | 3 HRS, 445° C. 795.8 A/m circumferential field | α-crystals, <15% Volume Fraction | 7 | 23 |

TABLE VI

| SAMPLE NO. | ALLOY | Annealed 435° C. - 3 hrs 30 mins - 795.8 A/m circumferential field: OXIDE LAYER THICKNESS (nm) Quenched | Annealed | 50 kHz, 0.1T Core Loss (W/kg) | 50 kHz, 0.1T Exciting Power (VA/kg) | OXIDE LAYER COMPOSITION |
|---|---|---|---|---|---|---|
| 1 | $Fe_{79}B_{16}Si_5$ | 8 | 8 | 16 | 47 | Silicon Oxide |
| 2 | $Fe_{77}B_{16}Si_5Cr_2$ | 8 | 8 | 8 | 29 | Chromium Oxide |
| 3 | $Fe_{76.85}B_{16.1}Si_{4.8}Cr_2C_{0.25}$ | 8 | 18 | 5 | 14 | Chromium Oxide |
| 4 | $Fe_{76}B_{16}Si_{5.25}Cr_2C_{0.75}$ | 9 | 15 | 9 | 20 | Chromium Oxide |
| 5 | $Fe_{76}B_{16.9}Si_5Cr_2C_1$ | 8 | 16 | 10 | 21 | Chromium Oxide |

Having thus described the invention in rather full detail, it will be understood that this detail need not be strictly adhered to but that various changes and modifications may suggest themselves to one skilled in the art, all falling within the scope of the invention as defined by the subjoined claims.

We claim:

1. A magnetic alloy having at least 70 percent of its structure in the form of an amorphous metal matrix and having a composition consisting essentially of about 75–83 atom percent iron, about 1–3 atom percent chromium, about 15–17 atom percent boron, about 4.5–5.5 atom percent silicon and about 0.1–0.75 atom percent carbon, said alloy having been annealed at a temperature and for a time sufficient to induce precipitation of discrete particles of its constituents in said amorphous metal matrix and to form a chromium oxide layer on the surface of said matrix.

2. An alloy as recited in claim 1, wherein said alloy has been annealed in the presence of a magnetic field.

3. An alloy as recited in claim 1, wherein said alloy has been annealed in the absence of a magnetic field.

4. An alloy as recited in claim 1, wherein said oxide layer is composed predominantly of chromium.

5. An alloy as recited in claim 4, wherein said oxide layer has a thickness of at least about 15 nm.

6. An alloy as recited in claim 1, wherein said annealing temperature ranges from about 425° C. to 445° C. and said annealing time ranges from about 3 to 4 hrs.

7. An alloy as recited in claim 1, wherein said composition consists essentially of about 76–77 atom percent iron, about 1.5–2.5 atom percent chromium, about 15.8–16.3 atom percent boron, about 4.75–5.25 atom percent silicon and about 0.2–0.5 atom percent carbon.

8. An alloy as recited in claim 1, consisting essentially of the composition $Fe_{76.85}Cr_2B_{16.1}Si_{4.8}C_{0.25}$ subscripts in atomic percent.

9. An alloy as recited in claim 1, having at least 85 percent of its structure in the form of an amorphous metal matrix.

* * * * *